428-911 SR
6/2/81 XR 4,271,225

United States Patent [19]
Camilleri

[11] 4,271,225
[45] Jun. 2, 1981

[54] PLOW PROTECTIVE MEMBER

[76] Inventor: Thomas M. Camilleri, 277 Ave. W, Brooklyn, N.Y. 11223

[21] Appl. No.: 968,754

[22] Filed: Dec. 13, 1978

[51] Int. Cl.[3] ..... A63D 9/00; B32B 27/34; B32B 25/00

[52] U.S. Cl. ..... 428/215; 273/42 A; 273/43 A; 273/46; 273/52; 428/316; 428/320; 428/475.5; 428/475.8; 428/476.1; 428/911

[58] Field of Search ..... 428/316, 320, 475.5, 428/492, 215, 315, 909, 474, 475.8, 476.1, 911; 273/42 A, 52, 43 A, 46

[56] References Cited

U.S. PATENT DOCUMENTS

| | | | |
|---|---|---|---|
| 2,690,769 | 10/1954 | Brown | 428/492 X |
| 2,905,582 | 9/1959 | Coleman et al. | 428/475.5 X |
| 3,506,264 | 4/1970 | Gautraud et al. | 273/43 A |
| 3,860,279 | 1/1975 | Hulten | 428/320 X |
| 4,101,704 | 7/1978 | Hiles | 428/315 |
| 4,181,768 | 1/1980 | Severin | 428/911 |

*Primary Examiner*—Harold Ansher
*Attorney, Agent, or Firm*—Donald J. Perrella

[57] ABSTRACT

A protective member for the plows of an automatic pinspotter bowling machine is formed of an outer layer of a wear-resistant ball-contacting member, an intermediate strengthening member, and an inner layer of cushioning material.

8 Claims, 3 Drawing Figures

PLOW PROTECTIVE MEMBER

BACKGROUND OF THE INVENTION

In automatic pinspotter bowling machines a member on each side of the machine acts to guide the bowling pins to the pin pickup mechanism at the rear of the machine. These members, known as "plows" because of their resemblence to agricultural plows, are made of metal. The plows are continuously battered by bowling pins that have been hit by the bowling balls. Eventually, the plows suffer metal fatigue and crack from the battering by the pins. They then have to be removed and repaired by welding, or replaced. Failure to remove a cracked plow will result in the bowling pins themselves being cut by the exposed edges along the crack. Welding the cracked plow is itself often unsatisfactory: if the weld is higher than the adjacent surface of the plow, the weld itself will cut the pins.

OBJECTS OF THE INVENTION

It is, accordingly, an object of the present invention to provide a protective member which will prevent the plow from cracking. Another object is to provide a protective member which can be readily and easily installed. These and other objects of the present invention will be apparent from the following description.

SUMMARY OF THE INVENTION

A protective member for the plows of an automatic pinspotter bowling machine is formed of an outer layer of a wear-resistant ball contacting member, an intermediate strengthening member, and an inner layer of cushioning material.

DETAILED DESCRIPTION

Figures 1, 2, 3:
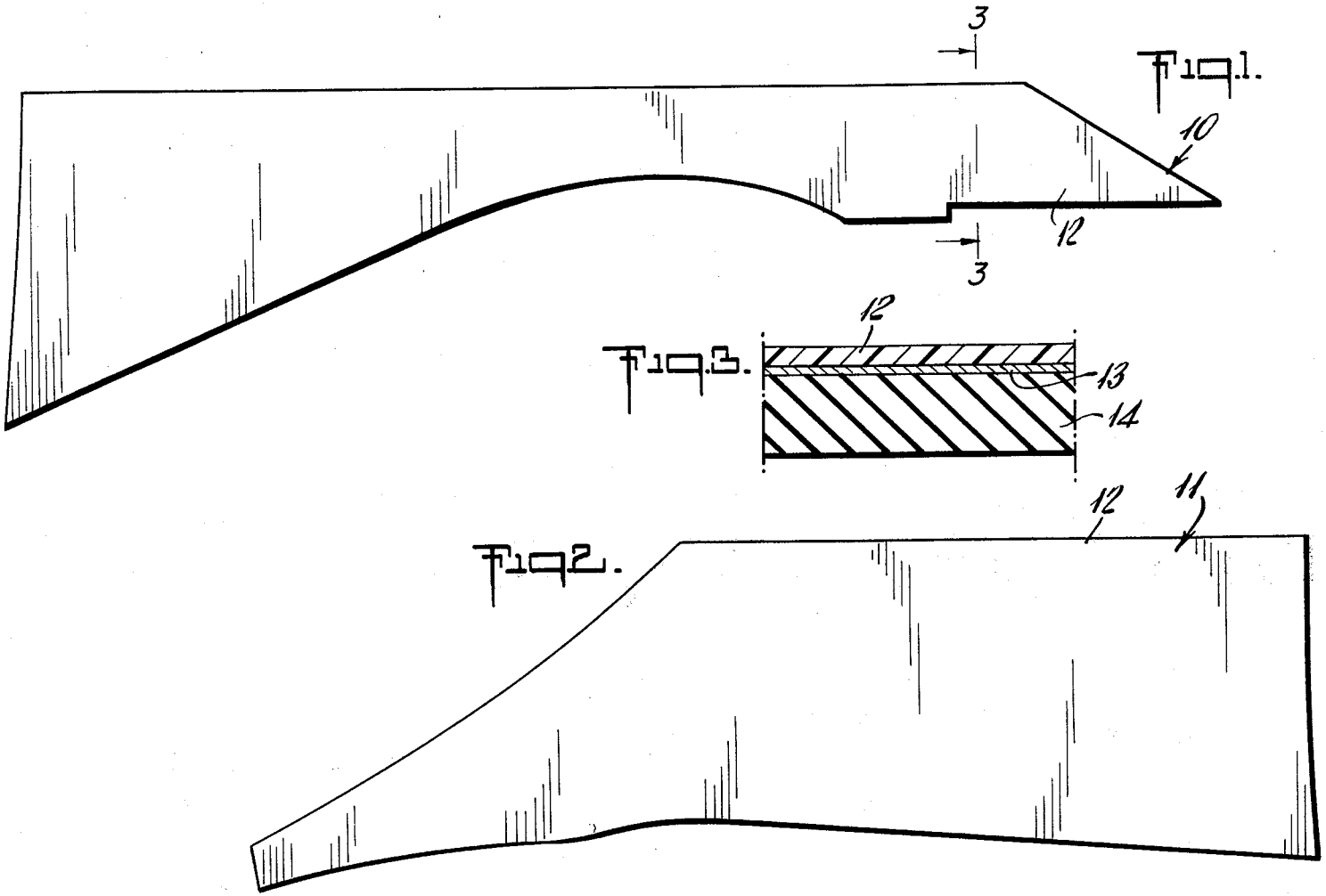
FIG. 1 is a plan view of a protective member for a plow for one side of the bowling machine.
FIG. 2 is a plan view of a protective member for a plow for the other side of the bowling machine.
FIG. 3 is a sectional view taken along the line 3—3 of FIG. 1.

The plow protective member of the present invention has a shape that conforms to the shape of the plow it is intended to protect. As the left side and right side plows have differing shapes, the plow protective members of the present invention have differing shapes depending on whether they are intended for use on either a left side plow or right side plow. FIG. 1 shows in plan view a protective member 10 of the present invention for one side plow while FIG. 2 shows in plan view a protective member 11 of the present invention for the other side plow. As shown in FIG. 3 the protective member of the present invention comprises three layers. The outer layer 12 which contacts the ball is formed of a wear-resistant, low coefficient of friction material, such as e.g., nylon. A suitable thickness for the top layer is from about 1/32 to about ⅛ inch, preferably about 1/16 inch. While thicker or thinner layers may be used, the foregoing range has been found practical. Material such as nylon has excellent long wearing properties but is susceptible to cracking from impact shock. The intermediate layer 13 is formed of a high tensile strength reinforcing member which promotes the integrity of the top layer and prevents cracking. Layer 13 conveniently is bonded to top layer 12 by means of a pressure sensitive adhesive layer (not shown as it is considered to be obvious). Examples of a suitable reinforcing member are Scotch brand filament tape or Scotch box sealing tape. The bottom layer 14 is formed of cushioning material such as, e.g., rubber, preferably sponge rubber. Layer 14 may be bonded to layer 13 on one side and to the surface of the plow on the other side by contact cement. A suitable thickness for sponge rubber is from about ⅛ inch to about ½ inch, preferably about ¼ inch.

The protecting member of the present invention has been found to completely absorb the impact of the bowling pins thus preventing the plow from cracking. They also produce a marked reduction in noise as the pins no longer strike the metal surface of the plow. The foregoing results are obtained whether the protective member of the present invention is applied to uncracked plows or to welded plows.

What is claimed is:

1. A protective member for the metal plow of an automatic pinspotter bowling machine which comprises a laminate formed of a pin contacting outer layer of wear-resistant, low coefficient of friction material, an intermediate layer of high tensile strength reinforcing material and an inner layer of cushioning material not penetrating the intermediate layer to contact the outer layer, the protective member conforming to the shape of the plow and adapted to be permanently affixed thereto.

2. A member according to claim 1 having an outer layer of nylon.

3. A member according to claim 2 having an intermediate layer of filament tape or sealing tape.

4. A member according to claim 1 having an inner layer of rubber.

5. A member according to claim 2 wherein the nylon has a thickness of from about 1/32 to about ⅛ inch.

6. A member according to claim 7 wherein the sponge rubber has a thickness of from about ⅛ to about ½ inch.

7. A member according to claim 1 having an inner layer of sponge rubber.

8. A member according to claim 7 wherein the nylon has a thickness of about 1/16 inch and the sponge rubber has a thickness of about ¼ inch.

* * * * *